US010895225B2

(12) United States Patent
Yamaguchi

(10) Patent No.: US 10,895,225 B2
(45) Date of Patent: Jan. 19, 2021

(54) INTAKE MANIFOLD

(71) Applicant: TOYOTA BOSHOKU KABUSHIKI KAISHA, Aichi-ken (JP)

(72) Inventor: Takuma Yamaguchi, Aichi-ken (JP)

(73) Assignee: TOYOTA BOSHOKU KABUSHIKI KAISHA, Aichi-ken (JP)

( * ) Notice: Subject to any disclaimer, the term of this patent is extended or adjusted under 35 U.S.C. 154(b) by 330 days.

(21) Appl. No.: 15/970,158

(22) Filed: May 3, 2018

(65) Prior Publication Data

US 2019/0003428 A1 Jan. 3, 2019

(30) Foreign Application Priority Data

Jun. 30, 2017 (JP) ..... 2017-129818

(51) Int. Cl.
*F02M 35/10* (2006.01)
*F02M 35/116* (2006.01)

(52) U.S. Cl.
CPC .. *F02M 35/10039* (2013.01); *F02M 35/1036* (2013.01); *F02M 35/1038* (2013.01); *F02M 35/10144* (2013.01); *F02M 35/10222* (2013.01); *F02M 35/1165* (2013.01)

(58) Field of Classification Search
CPC ..... F02M 35/10039; F02M 35/10144; F02M 35/10222; F02M 35/1036; F02M 35/1038; F02M 35/1165
See application file for complete search history.

(56) References Cited

U.S. PATENT DOCUMENTS

2005/0056237 A1 3/2005 Matsuda
2010/0164225 A1* 7/2010 Ishikawa ..... F02M 35/10039 285/119
2010/0288247 A1 11/2010 Tanikawa et al.
2019/0003429 A1* 1/2019 Miyashita ..... F02M 35/10222

FOREIGN PATENT DOCUMENTS

JP H11-064145 A 3/1999
JP H11-141417 A 5/1999
JP 2005-042654 A 2/2005
JP 2010-265870 A 11/2010
JP 2011-043105 3/2011

OTHER PUBLICATIONS

Japanese Office Action, Japanese Patent Office, Application No. 2017-129818, dated Nov. 24, 2020, with English translation.

* cited by examiner

*Primary Examiner* — Lindsay M Low
*Assistant Examiner* — Ruben Picon-Feliciano
(74) *Attorney, Agent, or Firm* — Greenblum & Bernstein, P.L.C.

(57) ABSTRACT

An intake manifold includes a surge tank and left and right intake pipes. On a part of an outer periphery portion of the surge tank that faces a front direction or a rear direction of a vehicle, a pressure measurement portion to measure pressure in the surge tank is provided. A pressure sensor is attached to the pressure measurement portion. A sensing space containing one end side that is opened in the surge tank and the other end side in which a pressure sensing portion of the pressure sensor is disposed is formed on the pressure measurement portion. A bottom surface constituting the sensing space of the pressure measurement portion is inclined downwardly toward an opening portion to the surge tank.

5 Claims, 6 Drawing Sheets

INTAKE MANIFOLD

CROSS-REFERENCE TO RELATED APPLICATION

The present application claims priority under 35 U.S.C. § 119 of Japanese Application No. 2017-129818 filed on Jun. 30, 2017, the disclosure of which is expressly incorporated by reference herein in its entirety.

BACKGROUND

1. Technical Field

The present invention relates to an intake manifold, and more particularly to an intake manifold which is mounted on a vehicle together with a horizontally opposed engine and which is disposed on an upper portion of the horizontally opposed engine.

2. Related Art

A conventional intake manifold which is mounted on a vehicle together with a horizontally opposed engine and which is disposed on an upper portion of the horizontally opposed engine has been typically known. As an intake manifold of this type, for example, the intake manifold which is known includes a surge tank containing an air inlet, left and right intake pipes containing one end sides each connected to the surge tank, respectively extending in a width direction of the vehicle, and containing the other end sides respectively connected to intake ports of the horizontally opposed engine, and a pressure sensor for measuring pressure in the surge tank which is attached to an upper surface portion of the surge tank.

It is ordinarily difficult to secure a mounting space of the pressure sensor on an upper surface portion of the intake manifold in an engine compartment because of restriction of a pedestrian protection line. Therefore, according to the conventional intake manifold described above, since it is necessary to lower height of the surge tank, capacity of the surge tank is reduced. Further, the intake manifold sometimes adopts an exhaust gas recirculation (EGR) system which introduces a part of exhaust gas into the surge tank and sends the exhaust gas together with intake air to each of combustion chambers of the engine in order to reduce NOx in the exhaust gas and improve fuel efficiency. In this case, according to the conventional intake manifold, since a pressure sensing portion of the pressure sensor is directly inserted into the surge tank, it is necessary to provide a soil prevention structure which is a complicated structure in the surge tank in order that the pressure sensing portion of the pressure sensor is not soiled with the exhaust gas.

An intake manifold to solve the problem described above is suggested (refer to, for example, Patent Literature 1; JP 2011-43105 A). The intake manifold which is disclosed in Patent Literature 1 is provided with a pressure measurement portion to which a pressure sensor is attached. The pressure measurement portion is provided on a crotch part of intake pipes to be adjacent to each other on an outer periphery portion of a surge tank. The pressure measurement portion is provided with a sensing space containing one end side which is opened in the surge tank and the other end side in which the pressure sensor is disposed. In Patent Literature 1, it is disclosed that an inclination is provided on a bottom surface of the sensing space so as to discharge condensed water generated from exhaust gas in the sensing space to a surge tank side (refer to, for example, paragraphs [0061], [0062], and FIG. 10).

However, according to the technique disclosed in Patent Literature 1, since the pressure measurement portion is provided on the crotch part of the intake pipes to be adjacent to each other on the outer periphery portion of the surge tank, a plane shape of the sensing space is restricted by distance between the adjacent intake pipes. For example, in cases where the distance between the adjacent intake pipes is relatively large, lateral width of the sensing space tends to be enlarged (refer to FIG. 5 of Patent Literature 1). In this case, although the inclination is provided on the bottom surface of the sensing space, the condensed water is highly likely to stay on a corner portion near to an opening end side of the sensing space.

SUMMARY

Embodiments of the present invention have been devised in view of the circumstances described above. An object of the present invention is to provide an intake manifold which secures large capacity of a surge tank, which restrains soil of a pressure sensing portion of a pressure sensor with exhaust gas even if an EGR system is adopted, and which restrains condensed water generated from, for example, the exhaust gas from staying in a sensing space.

One aspect of the present embodiments provides an intake manifold to be mounted on a vehicle together with a horizontally opposed engine and to be disposed on an upper portion of the horizontally opposed engine, the intake manifold comprising: a surge tank including an air inlet; and left and right intake pipes including one end sides each connected to the surge tank, respectively extending in a width direction of the vehicle, and including the other end sides respectively connected to intake ports of the horizontally opposed engine, wherein a pressure measurement portion to measure pressure in the surge tank is provided on a part of an outer periphery portion of the surge tank that faces a front direction or a rear direction of the vehicle, a pressure sensor is attached to the pressure measurement portion, a sensing space including one end side that is opened in the surge tank and the other end side in which a pressure sensing portion of the pressure sensor is disposed is formed on the pressure measurement portion, and a bottom surface constituting the sensing space of the pressure measurement portion is inclined downwardly toward an opening portion of the sensing space to the surge tank.

In a further aspect, the sensing space may include a passage containing one end side that is opened in the surge tank, and a sensor arrangement space that is connected to the other end side of the passage, in which the pressure sensing portion of the pressure sensor is disposed, and whose width is larger than a width of the passage, a bottom surface constituting the passage of the pressure measurement portion may be inclined downwardly toward an opening portion of the passage to the surge tank, and a bottom surface constituting the sensor arrangement space of the pressure measurement portion may be formed into a figure of V shape in a vertical section along a width direction of the sensor arrangement space and is inclined downwardly toward a connection part of the sensor arrangement space to the passage.

In a further aspect, the passage may include: a first passage containing one end side that is opened in the surge tank and extending in a longitudinal direction of the vehicle; and a second passage containing one end side that is connected to the other end side of the first passage, extending in the width direction of the vehicle, and containing the other end side that is connected to the sensor arrangement space.

In a further aspect, the pressure sensing portion of the pressure sensor may be disposed on the front direction or the rear direction of the vehicle relative to a connection part to the second passage in the sensor arrangement space.

In a further aspect, the passage and the sensor arrangement space may be connected to each other with a curved surface that is formed on the pressure measurement portion.

In a further aspect, a sensor installation portion having an insertion hole into which the pressure sensing portion of the pressure sensor is inserted and a sensor tightening portion to which the pressure sensor is tightened may be provided on an upper surface side of the pressure measurement portion, the sensor installation portion and the sensor tightening portion may be disposed in line in a longitudinal direction of the vehicle, and the sensor arrangement space may be a space that is covered with the sensor installation portion and the sensor tightening portion.

According to embodiments, an intake manifold includes a surge tank containing an air inlet, and left and right intake pipes containing one end sides each connected to the surge tank, respectively extending in a width direction of the vehicle, and containing the other end sides respectively connected to intake ports of a horizontally opposed engine. A pressure measurement portion to measure pressure in the surge tank is provided on a part of an outer periphery portion of the surge tank that faces a front direction or a rear direction of the vehicle. A pressure sensor is attached to the pressure measurement portion and a sensing space containing one end side that is opened in the surge tank and the other end side in which a pressure sensing portion of the pressure sensor is disposed is formed on the pressure measurement portion. A bottom surface constituting the sensing space of the pressure measurement portion is inclined downwardly toward an opening portion of the sensing space to the surge tank. Therefore, since the pressure sensor is provided to avoid a pedestrian protection line, a large capacity of the surge tank is secured. Even if an EGR system is adopted, soil of the pressure sensing portion of the pressure sensor is restrained since the exhaust gas is restrained from entering a side of the pressure sensing portion of the pressure sensor by the sensing space. Since a plane shape of the sensing space is easily formed into a form suitable to be drainable, the condensed water generated from, for example, the exhaust gas in the sensing space is effectively discharged to a side of the surge tank by providing inclination on the bottom surface of the sensing space. Hence, poor sensing by freezing of the condensed water and material deterioration by the condensed water in the sensing space are restrained.

In cases where the sensing space includes a passage and a sensor arrangement space, a bottom surface constituting the passage of the pressure measurement portion is inclined downwardly toward an opening portion of the passage to the surge tank, and a bottom surface constituting the sensor arrangement space of the pressure measurement portion is formed into a figure of V shape in a vertical section along a width direction of the sensor arrangement space and is inclined downwardly toward a connection part of the sensor arrangement space to the passage, the condensed water generated from, for example, the exhaust gas on the bottom surface of the sensor arrangement space flows toward the connection part to the passage, gathering to a side of a bottom of ravine of the bottom surface, so that the condensed water reaches the bottom surface of the passage. The condensed water on the bottom surface of the passage flows toward the opening portion to the surge tank to be discharged into an inside of the surge tank.

In cases where the passage includes a first passage and a second passage, the exhaust gas in the surge tank is further effectively restrained from entering the side of the pressure sensing portion of the pressure sensor by the passage formed into a bent shape.

In cases where the pressure sensing portion of the pressure sensor is disposed on the front direction or the rear direction of the vehicle relative to a connection part to the second passage in the sensor arrangement space, the exhaust gas in the surge tank is further effectively restrained from entering the side of the pressure sensing portion of the pressure sensor since the pressure sensing portion of the pressure sensor is arranged at the depths relative to the second passage in a longitudinal direction of the vehicle.

In cases where the passage and the sensor arrangement space are connected to each other with a curved surface that is formed on the pressure measurement portion, drainability of the condensed water generated in the sensing space is improved.

In cases where a sensor installation portion and a sensor tightening portion that are predetermined are provided on an upper surface side of the pressure measurement portion, the sensor installation portion and the sensor tightening portion may be disposed in line in a longitudinal direction of the vehicle, and the sensor arrangement space may be a space that is covered with the sensor installation portion and the sensor tightening portion, the drainability of the condensed water generated in the sensing space is further improved and the exhaust gas is further effectively restrained from entering the sensing space.

BRIEF DESCRIPTION OF DRAWINGS

The present invention is further described in the detailed description which follows, in reference to the noted plurality of drawings by way of non-limiting examples of exemplary embodiments of the present invention, in which like reference numerals represent similar parts throughout the several views of the drawings, and wherein.

DETAILED DESCRIPTION

The particulars shown herein are by way of example and for purposes of illustrative discussion of the embodiments of the present invention only and are presented in the cause of providing what is believed to be the most useful and readily understood description of the principles and conceptual aspects of the present invention. In this regard, no attempt is made to show structural details of the present invention in more detail than is necessary for the fundamental understanding of the present invention, the description is taken with the drawings making apparent to those skilled in the art how the forms of the present invention may be embodied in practice.

Figure 1:
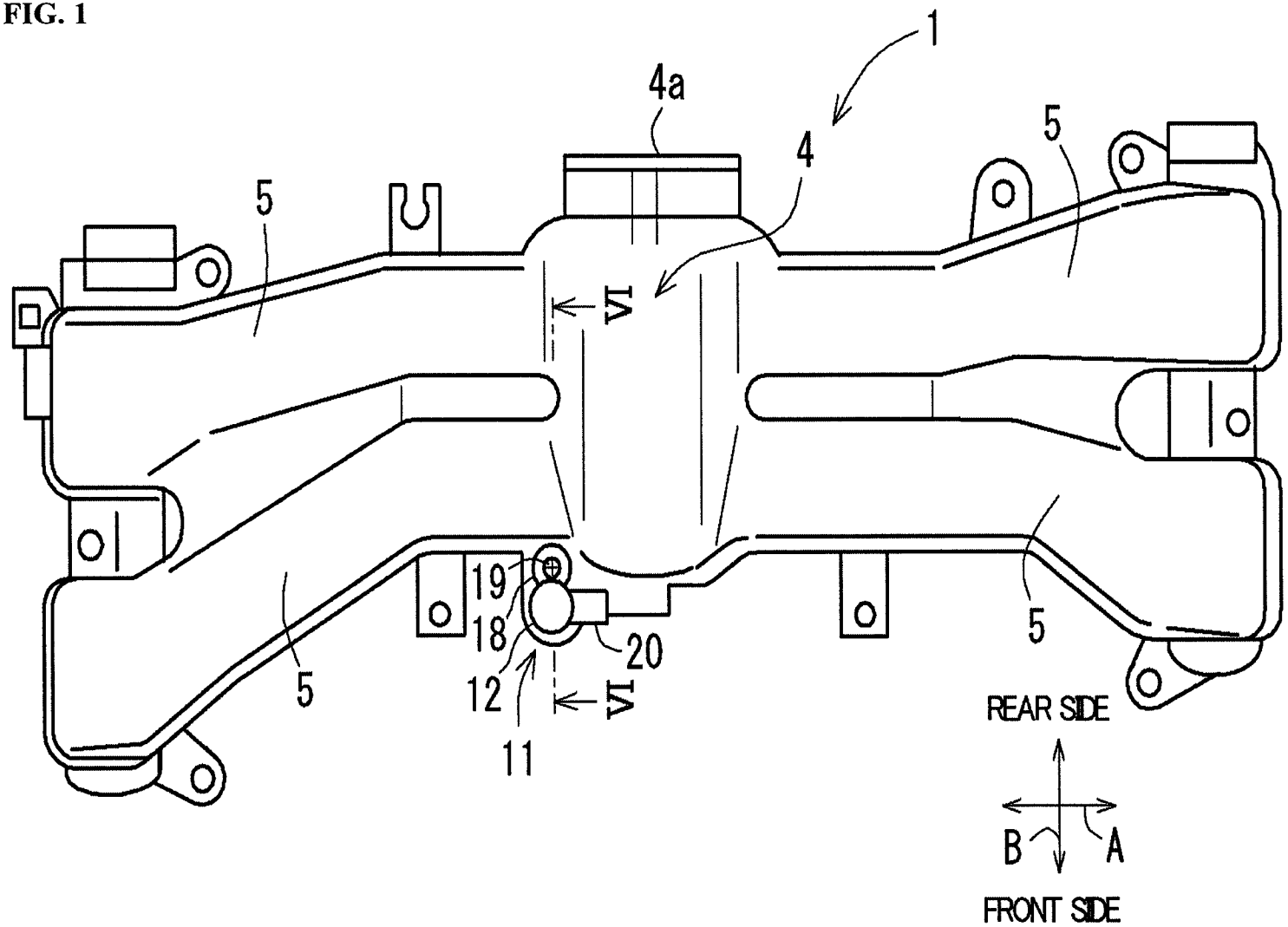
FIG. 1 is a plane view of an intake manifold of an example.

According to this embodiment, an intake manifold (1) to be mounted on a vehicle together with a horizontally opposed engine (2) and to be disposed on an upper portion of the horizontally opposed engine includes a surge tank (4) containing an air inlet (4*a*) and left and right intake pipes (5) containing one end sides each connected to the surge tank, respectively extending in a width direction (A) of the vehicle, and containing the other end sides respectively connected to intake ports of the horizontally opposed engine (refer to, for example, FIG. 1). On a part of an outer periphery portion of the surge tank (4) which faces a front direction or a rear direction of the vehicle, a pressure measurement portion (11) to measure pressure in the surge tank is provided (refer to, for example, FIGS. 7A, 7B). A pressure sensor (12) is attached to the pressure measurement portion (11) and a sensing space (25) containing one end side which is opened in the surge tank (4) and the other end side in which a pressure sensing portion (12*a*) of the pressure sensor is disposed is formed on the pressure measurement portion (11). A bottom surface (25*a*) constituting the sensing space of the pressure measurement portion (11) is inclined downwardly toward an opening portion of the sensing space (25) to the surge tank (4) (refer to, for example, FIGS. 2 to 4).

According to the intake manifold of this embodiment, for example, the sensing space (25) includes a passage (26) containing one end side which is opened in the surge tank (4) and a sensor arrangement space (27) which is connected to the other end side of the passage, in which the pressure sensing portion (12*a*) of the pressure sensor is disposed, and whose width (W) is larger than a width of the passage (26). A bottom surface (26*a*) constituting the passage of the pressure measurement portion (11) is inclined downwardly toward an opening portion of the passage (26) to the surge tank (4). A bottom surface (27*a*) constituting the sensor arrangement space of the pressure measurement portion (11) is formed into a figure of V shape in a vertical section along a width direction of the sensor arrangement space (27) and inclined downwardly toward a connection part of the sensor arrangement space (27) to the passage (26) (refer to, for example, FIGS. 2 to 6).

Figure 3:
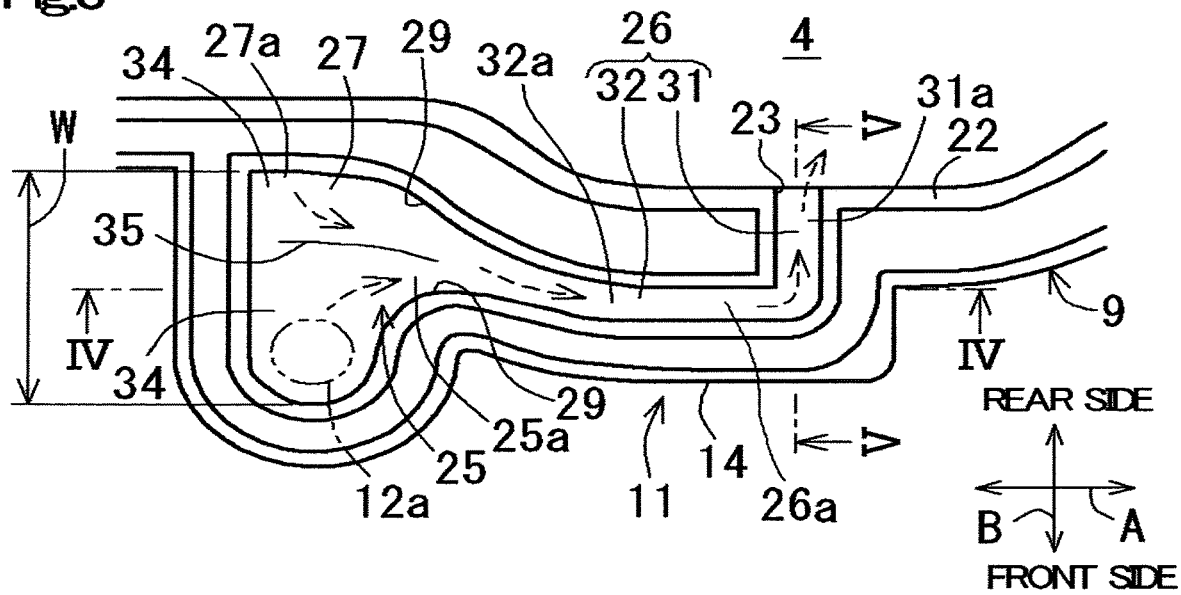
FIG. 3 is a plane view of an essential part of a lower forming body constituting the intake manifold.

In a case described above, for example, the passage (26) may include a first passage (31) containing one end side which is opened in the surge tank (4) and extending in a longitudinal direction (B) of the vehicle, and a second passage (32) containing one end side which is connected to the other end side of the first passage, extending in a width direction (A) of the vehicle, and containing the other end side which is connected to the sensor arrangement space (27) (refer to, for example, FIG. 3). In this case, for example, the pressure sensing portion (12*a*) of the pressure sensor may be disposed on the front direction or the rear direction of the vehicle relative to a connection part to the second passage (32) in the sensor arrangement space (27).

Incidentally, the reference signs in parentheses of the components described in the above embodiment respectively indicate a correspondence with a concrete composition mentioned in examples which will be described later.

Examples

With reference to the drawings, a concrete description of the present invention will be made hereinafter by way of examples. Incidentally, a width direction "A" of the vehicle and a longitudinal direction "B" in the drawings indicate directions in a state where the intake manifold is mounted on the vehicle together with the horizontally opposed engine.

(1) Structure of Intake Manifold

Figure 7A:
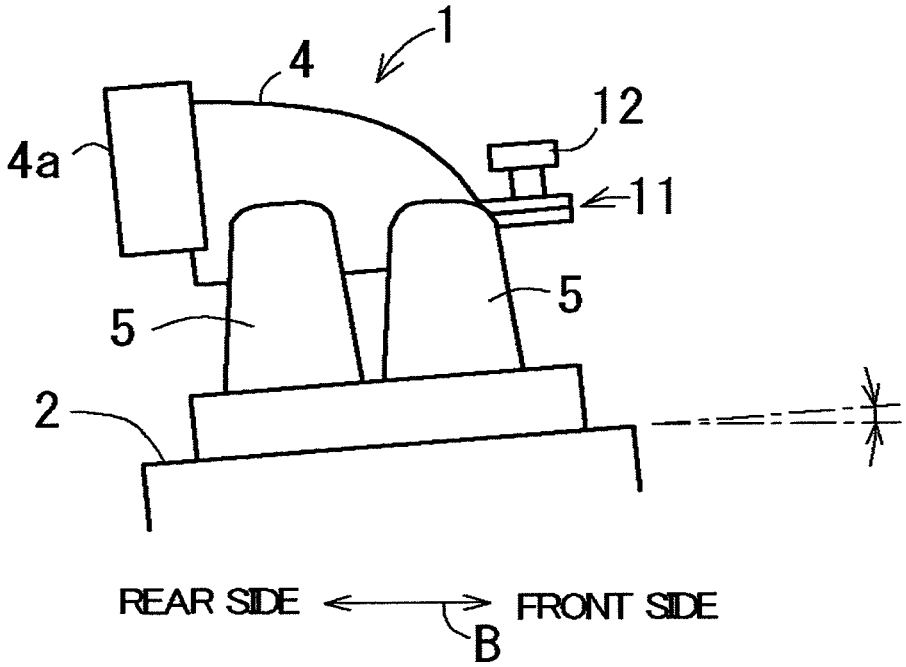
FIG. 7A is a diagram in explaining an installation state of the intake manifold on a vehicle, showing a form in which a slant angle of an engine is upwardly inclined toward a front direction of the vehicle.

According to this example, as shown in FIG. 7A, the intake manifold 1 is mounted on the vehicle together with the horizontally opposed engine 2 (which may be referred to as simply "engine" hereinafter) and is disposed on the upper portion of the engine 2. A slant angle of the engine 2 is upwardly inclined toward the front direction of the vehicle. According to this example, the intake manifold adopts an exhaust gas recirculation (EGR) system which introduces a part of exhaust gas into the surge tank 4 and sends the exhaust gas together with intake air to each of combustion chambers of the engine 2 in order to reduce NOx in the exhaust gas and improve fuel efficiency.

As shown in FIG. 1, the intake manifold 1 includes the surge tank 4 containing the air inlet 4*a* and the left and right intake pipes 5 containing one end sides each connected to the surge tank 4, respectively extending in the width direction A of the vehicle, and containing the other end sides respectively connected to the intake ports 40 (refer to FIG. 8) of the engine 2. Air (intake air) which passes through an air cleaner (not shown) is introduced into the air inlet 4*a*. Into the surge tank 4, a part of the exhaust gas is supplied from an exhaust route of the engine 2 through a gas supply conduit 6 (refer to FIG. 2). A pair of the left intake pipes 5 and a pair of the right intake pipes 5 are respectively provided on left and right sides to correspond to a pair of the combustion chambers which are respectively disposed on both left and right sides of the engine 2. Each of tip sides of the intake pipes 5 curves downwardly (that is, a side of the engine 2) and includes a flange 5*a* which is tightened to the side of the engine 2 with bolts or the like (refer to FIGS. 8A, 8B).

Figure 8A:
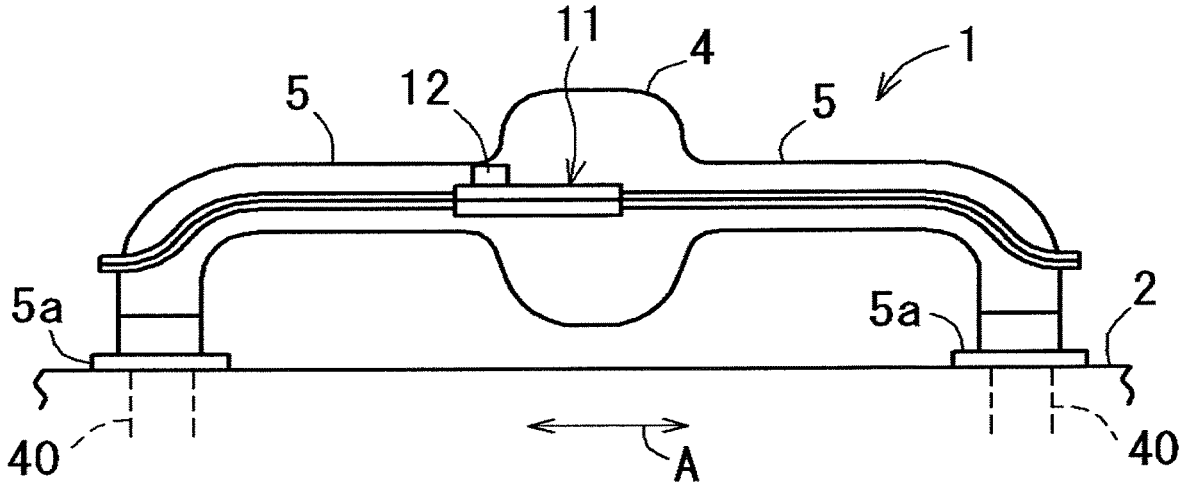
FIG. 8A is a front view of the intake manifold in an assembly state.
Figure 8B:
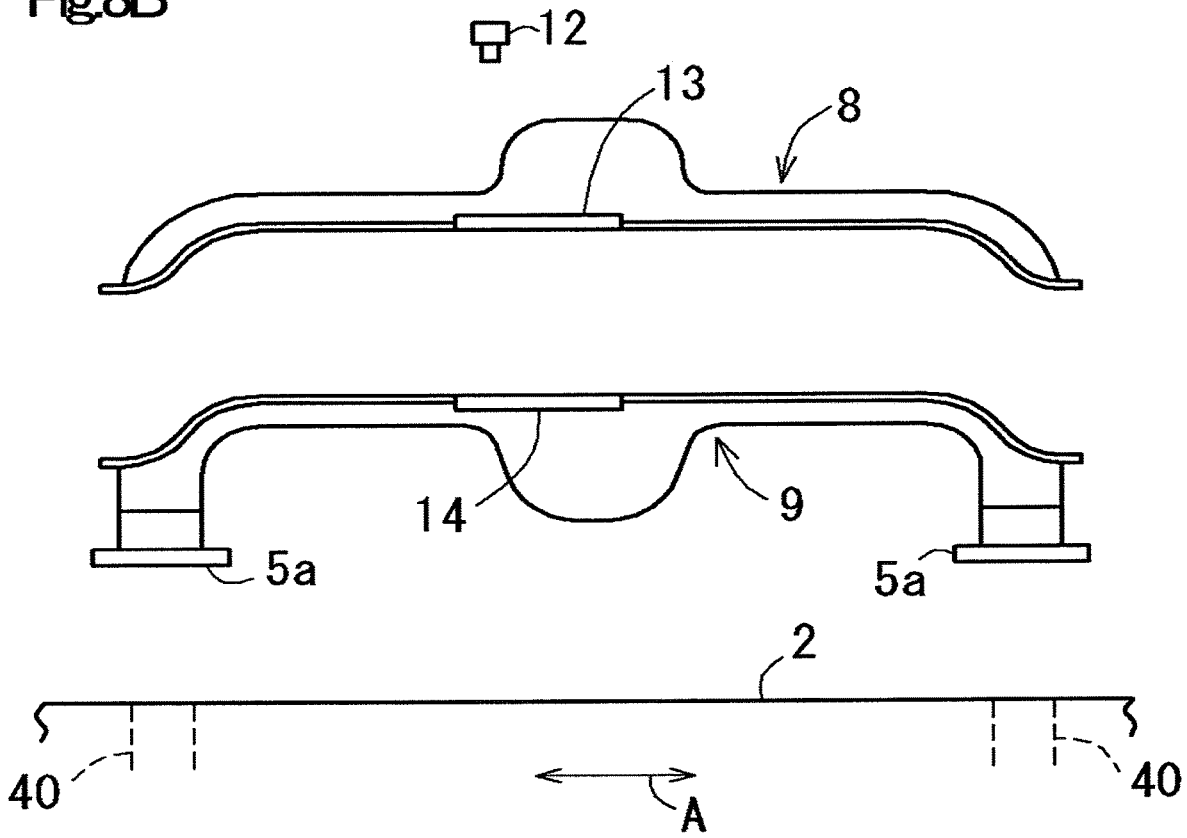
FIG. 8B is a front view of the intake manifold in an exploded state.

The intake manifold 1 is formed of synthetic resin of excellent heat resistance, for example, polyamide resin. As shown in FIGS. 8A, 8B, the intake manifold 1 is structured by joining an upper forming body 8 which forms an upper surface side of the intake manifold and a lower forming body 9 which forms a lower surface side of the intake manifold by, for example, vibration welding. Each of the upper forming body 8 and the lower forming body 9 is formed into a half divided shape obtained by vertically dividing the intake manifold 1 into halves.

Figure 2:
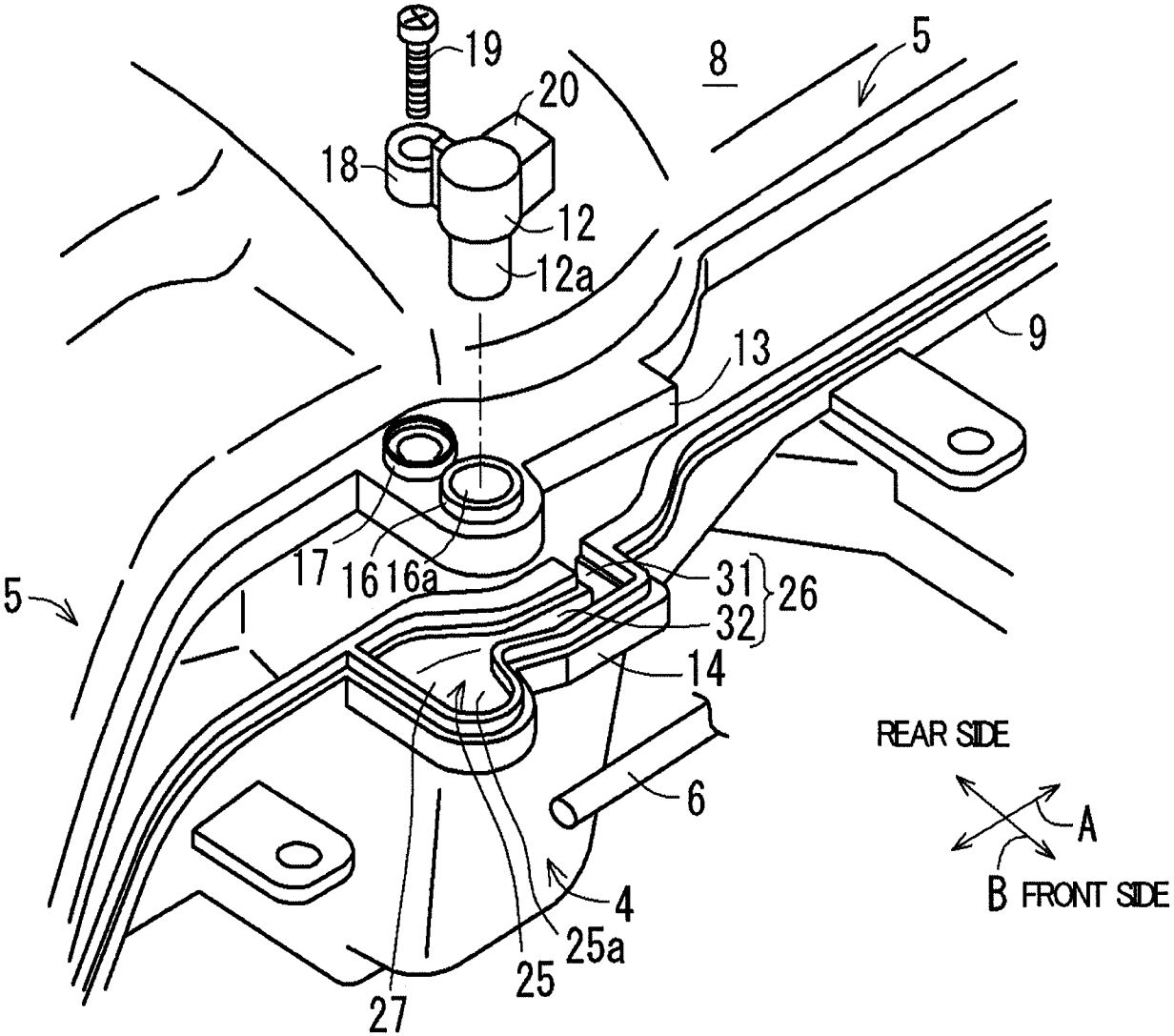
FIG. 2 is an exploded perspective view of an essential part of the intake manifold.

As shown in FIGS. 1 to 3, on a part of the outer periphery portion of the surge tank 4 which faces the front direction of the vehicle in a state where the intake manifold 1 is mounted on the vehicle, the pressure measurement portion 11 to measure intake air pressure in the surge tank 4 is provided. The pressure sensor 12 is attached to an upper surface portion of the pressure measurement portion 11. On the pressure measurement portion 11, the sensing space 25 containing one end side which is opened in the surge tank 4 and the other end side in which the pressure sensing portion 12*a* of the pressure sensor 12 is disposed is formed.

Figure 6:
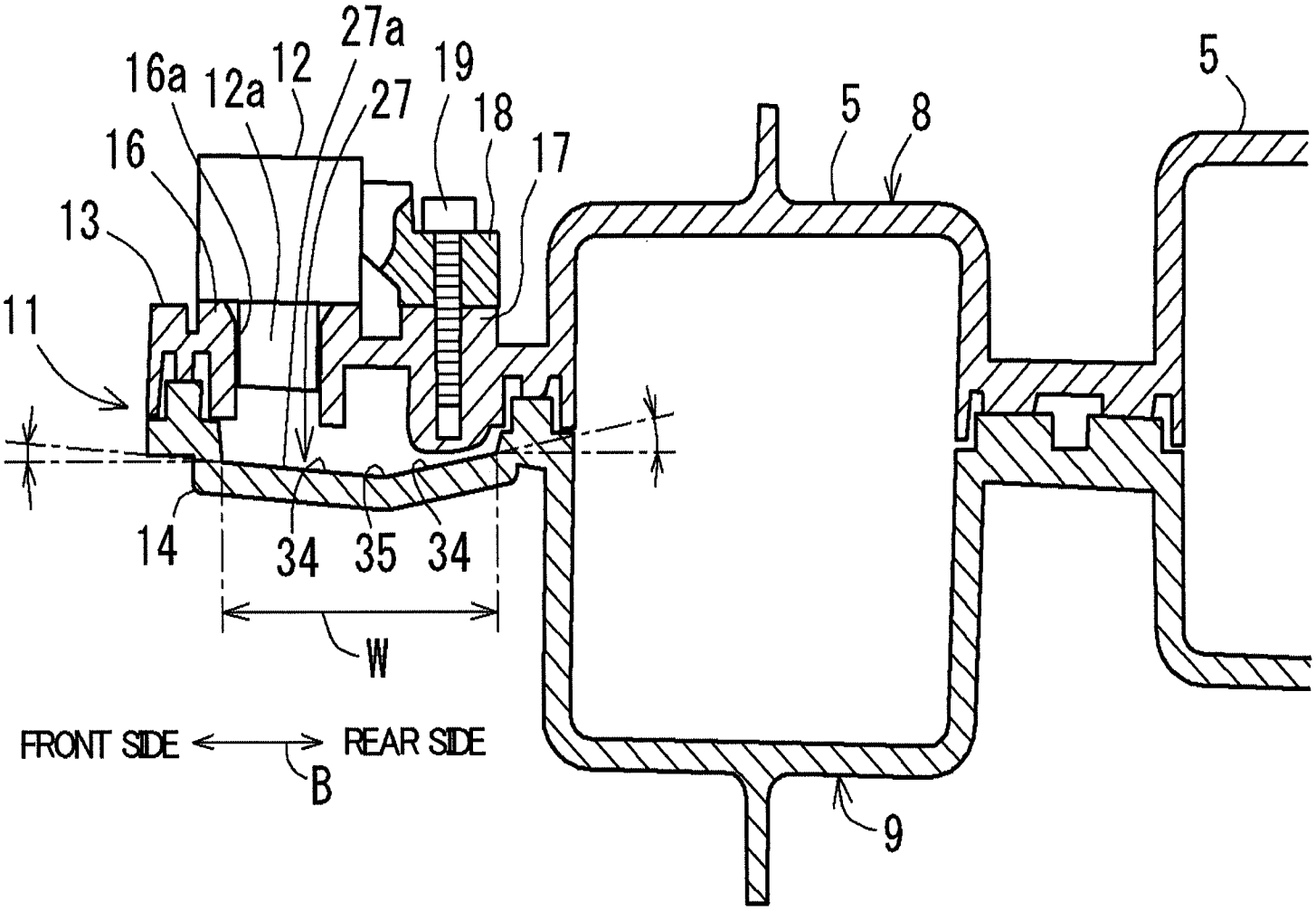
FIG. 6 is an enlarged sectional view taken along line VI-VI in FIG. 1.

The pressure measurement portion 11 includes an upper cover 13 which is integrally formed on the upper forming body 8 and a lower cover 14 which is integrally formed on the lower forming body 9 and which is joined to the upper cover 13 by, for example, vibration welding. As shown in FIG. 6, the pressure measurement portion 11 (specifically the upper cover 13) is provided with a sensor installation portion 16 on which the pressure sensor 12 is installed and a sensor tightening portion 17 to which the pressure sensor 12 is tightened. The pressure sensing portion 12*a* of the pressure sensor 12 is inserted into an insertion hole 16*a* formed in the sensor installation portion 16 so that the pressure sensing portion 12*a* faces an inside of the sensing space 25. Further, an insertion sleeve 18 is provided on an outer periphery side of the pressure sensor 12. A mounting screw 19 inserted into the insertion sleeve 18 is screwed into the sensor tightening portion 17, so that the pressure sensor 12 is attached to the pressure measurement portion 11. On the outer periphery side of the pressure sensor 12, a connector 20 to connect the pressure sensor 12 and a controller (not shown) by wire is provided.

Incidentally, the sensing space 25 is formed between the upper cover 13 and the lower cover 14 (refer to FIG. 2). On the upper forming body 8 and the lower forming body 9, a joint rib 22 (specifically a weld rib) constituting the surge tank 4 is partially cut out, so that the opening portion of the sensing space 25 to the surge tank 4 is formed by a notch 23 (refer to FIG. 3).

As shown in FIGS. 2, 3, the sensing space 25 includes the passage 26 containing one end side which is opened in the surge tank 4 and the sensor arrangement space 27 which is connected to the other end side of the passage 26, in which a pressure sensing portion 12*a* of the pressure sensor 12 is disposed, and whose width W is larger than the width of the passage 26. The sensor arrangement space 27 is a space covered with the sensor installation portion 16 and the sensor tightening portion 17. On the pressure measurement portion 11, a curved surface 29 connecting the passage 26 and the sensor arrangement space 27 is formed (that is, the curved surface 29 is curved in planar view of the sensing space 25).

The passage 26 includes the first passage 31 containing one end side which is opened in the surge tank 4 and extending in the longitudinal direction B of the vehicle, and the second passage 32 containing one end side which is connected to the other end side of the first passage 31, extending in the width direction A of the vehicle, and containing the other end side which is connected to the sensor arrangement space 27. The other end side of the second passage 32 is connected to a middle part of the sensor arrangement space 27 in a width direction of the sensor arrangement space 27. The pressure sensing portion 12*a* of the pressure sensor 12 is disposed on the front direction of the vehicle relative to the connection part to the second passage 32 in the sensor arrangement space 27.

Figure 4:
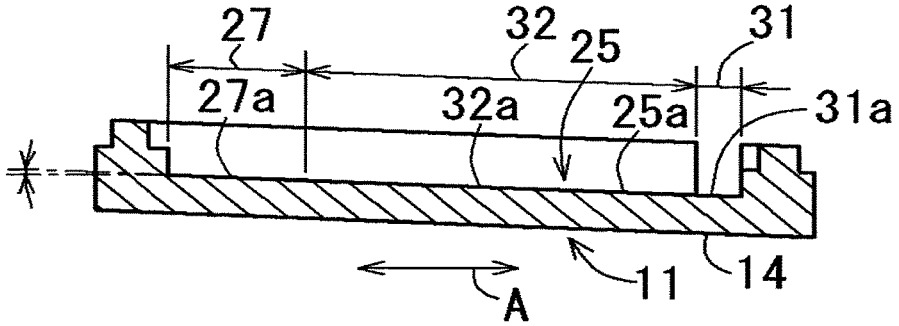
FIG. 4 is a sectional view taken along line IV-IV in FIG. 3.

In a state where the intake manifold 1 is mounted on the vehicle, the bottom surface 25*a* constituting the sensing space 25 of the pressure measurement portion 11 is inclined downwardly toward the opening portion of the sensing space 25 to the surge tank 4 (refer to FIG. 4).

Figure 5:
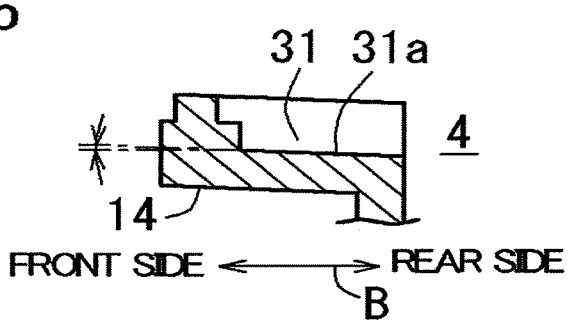
FIG. 5 is a sectional view taken along line V-V in FIG. 3.

Specifically, as shown in FIGS. 3 to 5, the bottom surface 26*a* constituting the passage 26 of the pressure measurement portion 11 is inclined downwardly toward the opening portion of the passage 26 to the surge tank 4. That is, a bottom surface 31*a* of the first passage 31 is inclined downwardly toward an opening portion of the first passage 31 to the surge tank 4. Further, a bottom surface 32*a* of the second passage 32 is inclined downwardly toward a connection part of the second passage 32 to the first passage 31.

As shown in FIGS. 4, 6, the bottom surface 27*a* constituting the sensor arrangement space 27 of the pressure measurement portion 11 is formed into a figure of V shape in the vertical section along the width direction of the sensor arrangement space 27 and inclined downwardly toward the connection part of the sensor arrangement space 27 to the passage 26. The bottom surface 27*a* of the sensor arrangement space 27 is provided with a pair of slant surfaces 34, 34 which intersect each other. The slant surfaces 34, 34 are inclined in a vertical direction relative to the longitudinal direction B of the vehicle. A bottom of ravine 35 (intersection portion 35) formed with the pair of slant surfaces 34, 34 is inclined in the vertical direction relative to the width direction A of the vehicle.

(2) Operation of Intake Manifold

An operation of the intake manifold 1 having the above structure will be described hereinafter. The air introduced from the air inlet 4*a* into the surge tank 4 is distributed to each of the intake pipes 5 to be sent to each of the intake ports of the engine 2 together with the exhaust gas supplied into the surge tank 4 through the gas supply conduit 6. The air in the surge tank 4 is introduced into the sensing space 25 of the pressure measurement portion 11, so that the intake air pressure in the surge tank 4 is measured by the pressure sensor 12.

Condensed water is sometimes generated from, for example, the exhaust gas in the sensing space 25 when the intake air pressure is measured by the pressure sensor 12. In this case, as shown by broken arrows in FIG. 3, the condensed water on the bottom surface 27*a* of the sensor arrangement space 27 flows toward the connection part to the passage 26, gathering to a side of the bottom of ravine 35 of the pair of slant surfaces 34, 34, so that the condensed water reaches the bottom surface 26*a* of the passage 26. The condensed water on the bottom surface 26*a* of the passage 26 flows toward the opening portion to the surge tank 4 to be discharged into the surge tank 4.

(3) Effects in this Example

According to this example, the intake manifold 1 includes the surge tank 4 containing the air inlet 4*a* and the left and right intake pipes 5 containing one end sides each connected to the surge tank 4, respectively extending in the width direction A of the vehicle, and containing the other end sides respectively connected to intake ports of the horizontally opposed engine 2. The pressure measurement portion 11 to measure the pressure in the surge tank 4 is provided on the part of the outer periphery portion of the surge tank 4 which faces the front direction of the vehicle. Further, the pressure sensor 12 is attached to the pressure measurement portion 11, and the sensing space 25 containing one end side which is opened in the surge tank 4 and the other end side in which the pressure sensing portion 12*a* of the pressure sensor 12 is disposed is formed on the pressure measurement portion 11. The bottom surface 25*a* constituting the sensing space 25 of the pressure measurement portion 11 is inclined downwardly toward the opening portion of the sensing space 25 to the surge tank 4. Therefore, since the pressure sensor 12 is provided to avoid a pedestrian protection line, a large capacity of the surge tank 4 is secured. Even if an EGR system is adopted, soil of the pressure sensing portion 12*a* of the pressure sensor 12 is restrained since the exhaust gas is restrained from entering a side of the pressure sensing portion 12*a* of the pressure sensor 12 by the sensing space 25. Since a plane shape of the sensing space 25 is formed into a form suitable to be drainable, the condensed water generated from, for example, the exhaust gas in the sensing space 25 is effectively discharged to a side of the surge tank 4 by providing inclination on the bottom surface 25*a* of the sensing space 25. Hence, poor sensing by freezing of the condensed water and material deterioration by the condensed water in the sensing space 25 are restrained.

According to this example, the sensing space 25 includes the passage 26 and the sensor arrangement space 27, the bottom surface 26*a* constituting the passage 26 of the pressure measurement portion 11 is inclined downwardly toward the opening portion of the passage 26 to the surge tank 4, and the bottom surface 27*a* constituting the sensor arrangement space 27 of the pressure measurement portion 11 is formed into a figure of V shape in the vertical section along the width direction of the sensor arrangement space 27 and inclined downwardly toward the connection part of the sensor arrangement space 27 to the passage 26. Therefore, the condensed water generated from, for example, the exhaust gas on the bottom surface 27*a* of the sensor arrangement space 27 flows toward the connection part to the passage 26, gathering to the side of the bottom of ravine 35 of the bottom surface 27*a*, so that the condensed water reaches the bottom surface 26*a* of the passage 26. The condensed water on the bottom surface 26*a* of the passage 26 flows toward the opening portion to the surge tank 4 to be discharged into the surge tank 4.

According to this example, the passage 26 includes the first passage 31 and the second passage 32. Therefore, the exhaust gas in the surge tank 4 is further effectively restrained from entering the side of the pressure sensing portion 12*a* of the pressure sensor 12 by the passage 26 formed into a bent shape.

According to this example, the pressure sensing portion 12*a* of the pressure sensor 12 is disposed on the front direction of the vehicle relative to the connection part to the second passage 32 in the sensor arrangement space 27. Hence, the exhaust gas in the surge tank 4 is further effectively restrained from entering the side of the pressure sensing portion 12*a* of the pressure sensor 12 since the pressure sensing portion 12*a* of the pressure sensor 12 is arranged at the depths relative to the second passage 32 in the longitudinal direction of the vehicle.

According to this example, on the pressure measurement portion 11, the curved surface 29 connecting the passage 26 and the sensor arrangement space 27 is formed. Hence, drainability of the condensed water in the sensing space 25 is further improved.

Figure 7B:
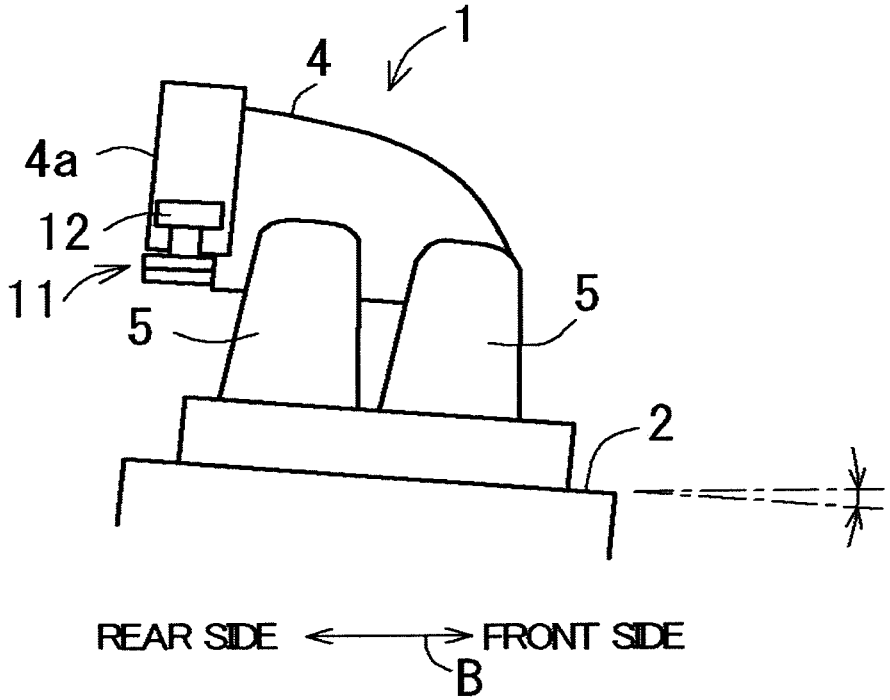
FIG. 7B is a diagram in explaining the installation state of the intake manifold on the vehicle, showing a form in which the slant angle of the engine is upwardly inclined toward a rear direction of the vehicle.

As many apparently widely different examples of this invention may be made without departing from the spirit and scope thereof, it is to be understood that the invention is not limited to the specific examples thereof except as defined in the appended claims. That is, according to the example described above, the intake manifold 1 to be used for the horizontally opposed engine 2 whose slant angle is upwardly inclined toward the front direction of the vehicle is provided with the pressure measurement portion 11 on the part of the outer periphery portion of the surge tank 4 which faces the front direction of the vehicle. However, it is to be understood that the present invention is not intended to be limited to this example. For example, as shown in FIG. 7B, the intake manifold 1 to be used for the horizontally opposed engine 2 whose slant angle is upwardly inclined toward the rear direction of the vehicle may be provided with the pressure measurement portion 11 on a part of the outer periphery portion of the surge tank 4 which faces the rear direction of the vehicle.

According to the example described above, the pressure sensing portion 12*a* of the pressure sensor 12 is disposed on the front direction of the vehicle relative to the connection part to the second passage 32 in the sensor arrangement space 27. However, it is to be understood that the present invention is not intended to be limited to this example. For example, the pressure sensing portion 12*a* of the pressure sensor 12 may be disposed on the rear direction of the vehicle relative to the connection part to the second passage 32 in the sensor arrangement space 27.

According to the example described above, a continuous inclination is provided on the bottom surface 25*a* of the sensing space 25. However, it is to be understood that the present invention is not intended to be limited to this example. For example, a horizontal surface may be provided on the bottom surface 25*a* of the sensing space 25 in addition to the inclination as long as appropriate drainability is obtained.

According to the example described above, the passage 26 is formed into the bent shape bent in one place. However, it is to be understood that the present invention is not intended to be limited to this example. For example, the passage may be formed into a linear shape, a curved shape, or a bent shape bent in two or more places.

According to the example described above, the sensor installation portion 16 and the sensor tightening portion 17 are arranged along the longitudinal direction B of the vehicle. However, it is to be understood that the present invention is not intended to be limited to this example. For example, the sensor installation portion 16 and the sensor tightening portion 17 may be arranged along the width direction A of the vehicle.

According to the example described above, the upper forming body 8 and the lower forming body 9 are joined to each other by vibration welding. However, it is to be understood that the present invention is not intended to be limited to this example. For example, the upper forming body 8 and the lower forming body 9 may be joined to each other by, for example, laser welding, ultrasonic welding, thermal welding, induced welding, or adhesion.

According to the example described above, the intake manifold 1 includes the pair of intake pipes 5 which are provided in line on both left and right sides of the surge tank 4 respectively. However, it is to be understood that the present invention is not intended to be limited to this example. For example, the intake manifold may include three or more intake pipes 5 which are provided in line on both the left and right sides of the surge tank 4 respectively. Incidentally, the shape, the number, and the like of the intake pipes 5 are appropriately selected in accordance with the form of the engine 2.

According to the example described above, the intake manifold 1 is made of synthetic resin. However, it is to be understood that the present invention is not intended to be limited to this example. For example, the intake manifold 1 may be made of metal, for example, aluminum.

According to the example described above, the intake manifold 1 adopts an EGR system. However, it is to be understood that the present invention is not intended to be limited to this example. For example, the intake manifold 1 may not adopt an EGR system.

It is noted that the foregoing examples have been provided merely for the purpose of explanation and are in no way to be construed as limiting of the present invention.

While the present invention has been described with reference to exemplary embodiments, it is understood that the words which have been used herein are words of description and illustration, rather than words of limitation. Changes may be made, within the purview of the appended claims, as presently stated and as amended, without departing from the scope and spirit of the present invention in its aspects. Although the present invention has been described herein with reference to particular structures, materials and embodiments, the present invention is not intended to be limited to the particulars disclosed herein; rather, the present invention extends to all functionally equivalent structures, methods and uses, such as are within the scope of the appended claims.

The present invention is not limited to the above-described embodiments, and various variations and modifications may be possible without departing from the scope of the present invention.

The present invention is widely used as a technology relating to an intake manifold sending air to a horizontally opposed engine which is used in a vehicle such as a passenger car, a bus, or a truck.

What is claimed is:

1. An intake manifold to be mounted on a vehicle together with a horizontally opposed engine and to be disposed on an upper portion of the horizontally opposed engine, the intake manifold comprising:

a surge tank including an air inlet; and left and right intake pipes including one end sides each connected to the surge tank, respectively extending in a width direction of the vehicle, and including the other end sides respectively connected to intake ports of the horizontally opposed engine, wherein a pressure measurement portion to measure pressure in the surge tank is provided on a part of an outer periphery portion of the surge tank that faces a front direction or a rear direction of the vehicle, a pressure sensor is attached to the pressure measurement portion, a sensing space including one end side that is opened in the surge tank and the other end side in which a pressure sensing portion of the pressure sensor is disposed is formed on the pressure measurement portion, a bottom surface constituting the sensing space of the pressure measurement portion is inclined downwardly toward an opening portion of the sensing space to the surge tank, the sensing space includes a passage containing one end side that is opened in the surge tank, and a sensor arrangement space that is connected to the other end side of the passage, in which the pressure sensing portion of the pressure sensor is disposed, and whose width is larger than a width of the passage, a bottom surface constituting the passage of the pressure measurement portion is inclined downwardly toward an opening portion of the passage to the surge tank, and a bottom surface constituting the sensor arrangement space of the pressure measurement portion is formed into a figure of V shape in a vertical section along a width direction of the sensor arrangement space and is inclined downwardly toward a connection part of the sensor arrangement space to the passage.

2. The intake manifold according to claim 1, wherein the passage includes:

a first passage containing one end side that is opened in the surge tank and extending in a longitudinal direction of the vehicle; and a second passage containing one end side that is connected to the other end side of the first passage, extending in the width direction of the vehicle, and containing the other end side that is connected to the sensor arrangement space.

3. The intake manifold according to claim 2, wherein the pressure sensing portion of the pressure sensor is disposed on the front direction or the rear direction of the vehicle relative to a connection part to the second passage in the sensor arrangement space.

4. The intake manifold according to claim 1, wherein the passage and the sensor arrangement space are connected to each other with a curved surface that is formed on the pressure measurement portion.

5. The intake manifold according to claim 1, wherein a sensor installation portion having an insertion hole into which the pressure sensing portion of the pressure sensor is inserted and a sensor tightening portion to which the pressure sensor is tightened are provided on an upper surface side of the pressure measurement portion, the sensor installation portion and the sensor tightening portion are disposed in line in a longitudinal direction of the vehicle, and the sensor arrangement space is a space that is covered with the sensor installation portion and the sensor tightening portion.

* * * * *